US010060672B2

(12) United States Patent
Wang

(10) Patent No.: US 10,060,672 B2
(45) Date of Patent: Aug. 28, 2018

(54) AIR SEPARATION APPARATUS TO PRODUCE OXYGEN AND NITROGEN THROUGH ISOBARIC SEPARATION

(71) Applicant: NANJING RECLAIMER ENVIRONMENTAL TEKNIK CO., LTD, Nanjing, Jiangsu (CN)

(72) Inventor: Haibo Wang, Jiangsu (CN)

(73) Assignee: NANJING RECLAIMER ENVIRONMENTAL TEKNIK CO., LTD, Nanjing, Jiangsu (CN)

( * ) Notice: Subject to any disclaimer, the term of this patent is extended or adjusted under 35 U.S.C. 154(b) by 240 days.

(21) Appl. No.: 14/763,708

(22) PCT Filed: Jan. 24, 2014

(86) PCT No.: PCT/CN2014/071341
§ 371 (c)(1),
(2) Date: Jul. 27, 2015

(87) PCT Pub. No.: WO2014/114258
PCT Pub. Date: Jul. 31, 2014

(65) Prior Publication Data

US 2015/0354888 A1 Dec. 10, 2015

(30) Foreign Application Priority Data

Jan. 27, 2013 (CN) ..... 2013 1 0030923

(51) Int. Cl.
*F25J 3/00* (2006.01)
*F25J 3/04* (2006.01)

(52) U.S. Cl.
CPC ..... *F25J 3/0426* (2013.01); *F25J 3/0409* (2013.01); *F25J 3/04084* (2013.01);
(Continued)

(58) Field of Classification Search
CPC .. F25J 3/04412; F25J 3/04418; F25J 3/04163; F25J 3/04127; F25J 3/04157;
(Continued)

(56) References Cited

U.S. PATENT DOCUMENTS 5,220,798 A * 6/1993 Nagamura ..... F25J 3/0406 62/50.2
6,053,008 A * 4/2000 Arman ..... F25J 3/0409 62/646
7,143,606 B2 * 12/2006 Tranier ..... F25J 1/0022 62/611

FOREIGN PATENT DOCUMENTS

CN 1789868 A 6/2006
CN 102072612 A 5/2011
CN 203224101 U 10/2013

* cited by examiner

*Primary Examiner* — Keith Raymond
(74) *Attorney, Agent, or Firm* — Novick, Kim & Lee, PLLC; Allen Xue

(57) ABSTRACT

This invention is about an air separation apparatus to produce oxygen and nitrogen through isobaric separation, which is based on the Rankine cycle system of similar thermal energy power circulation apparatus at cryogenic side, a liquid pump is used to input work and the cold is made up to the air separation apparatus with refrigerating media, so as to realize the isobaric separation of air to produce nitrogen and oxygen. The air separation apparatus of this invention can save energy by over 30% as compared with the traditional advanced apparatus with the identical refrigerating capacity, and it can also realize centralize gas supply via the air separation apparatus, therefore it constitutes a breakthrough to the traditional air separation technology and refrigeration theory, with substantial economic, social and environmental protection benefits.

9 Claims, 5 Drawing Sheets

(52) U.S. Cl.
CPC ..... *F25J 3/04127* (2013.01); *F25J 3/04157* (2013.01); *F25J 3/04163* (2013.01); *F25J 3/04224* (2013.01); *F25J 3/04248* (2013.01); *F25J 3/04254* (2013.01); *F25J 3/04278* (2013.01); *F25J 3/04412* (2013.01); *F25J 3/04418* (2013.01); *F25J 2200/06* (2013.01); *F25J 2200/20* (2013.01); *F25J 2205/24* (2013.01); *F25J 2210/42* (2013.01); *F25J 2235/42* (2013.01); *F25J 2240/44* (2013.01); *F25J 2270/14* (2013.01)

(58) Field of Classification Search
CPC .. F25J 2200/04; F25J 2200/06; F25J 3/04084; F25J 3/0409; F25J 3/04278; F25J 3/04254; F25J 3/0426; F25J 3/04266; F25J 3/04272; F25J 3/04018; F25J 3/04024; F25J 3/04169; F25J 3/04175; F25J 3/04187; F25J 3/0423; F25J 2205/24
See application file for complete search history.

AIR SEPARATION APPARATUS TO PRODUCE OXYGEN AND NITROGEN THROUGH ISOBARIC SEPARATION

TECHNICAL FIELD

This invention is about an air separation apparatus to produce oxygen and nitrogen through isobaric separation, specifically it falls into the technical field of cryogenic refrigeration.

BACKGROUND OF THE INVENTION

Air separation apparatuses play an essential role in the rapid development of national economy. The so-called air separation apparatus (generally referred to as oxygenerator) is one based on the principle of cryogenic refrigeration to liquefy air, and then rectify it in the rectification column for different components with different boiling points, and to finally obtain oxygen and nitrogen, or to concurrently extract one or more rare gases.

In 1939, a scientist of the USSR Academician Kapitza invented the high efficiency (>80%) radial flow centripetal reaction turbine expander, paving the way for the birth of full-low-pressure oxygenerator. Kapitza turbine expander is the foundation for the development of turbine expanders in all countries of the world in modern times, and Kapitza low pressure liquefaction cycle is the foundation of modern large oxygenerators. In the cryogenic technology field, British scientists Joule and Thomson discovering Joule—Thomson effect in 1852 is the first milestone, the invention and realization of "Crout cycle" is the second milestone, and the "Kapitza cycle" and the birth of full-low-pressure oxygenerator is the third milestone.

With the growth of demand for oxygen, nitrogen and other air separation products in iron and steel, metallurgical, chemical industries, especially coal chemical industry, oxygenerator is developing into large and extra-large scale, in China, extra-large oxygenerator has reached a capacity of 90000 $m^3/h$, and new technologies and processes of oxygen production also merge endlessly. At present, cryogenic oxygen production processes in China has fully popularized the new process of the 6th generation. The apparatus consumption in oxygen production has reduced from the former over 3 $kw \cdot h/m^3O_2$ to about 0.37 $kw \cdot h/m^3O_2$, and products from oxygenerators are not limited to the single oxygen gas, they include both gas and liquid products, such as pure oxygen, pure nitrogen, pure argon, and the extraction of rare gases. Oxygen production technologies and oxygenerators have been developing all the way in the direction of safety, smartness, energy conservation, simplified process and reduced investment.

The following is a brief description of 4 typical and traditional processes:

FIG. 1 is a process schematic diagram of a tube type 3200 $m^3/h$ oxygenerator, in which: 101—cold accumulator, 102—automatic valve box, 103—turbine expander, 104—expansion filter, 105—liquefier, 106—lower column, 107—condensing evaporator, 108—upper column, 109—liquid oxygen absorber, 110—liquid air absorber, 111—liquid nitrogen subcooler, 113—liquid oxygen pump, 114—carbon dioxide absorber. This type of oxygenerator is based on the high efficiency turbine expander refrigerating full-low-pressure process, or the Kapitza cycle, the stone-packed cold accumulator embedded with coilers is used to freeze and remove water and carbon dioxide, its non-freezability is ensured by middle extraction, and the middle extraction carbon dioxide adsorber 104 is used to remove the carbon dioxide from the extracted gas. The oxygen-enriched liquid air flows via the liquid air adsorption filter to remove the carbon dioxide dry ice, and adsorb the acetylene from the liquid air, liquid oxygen pump 113 is provided to circulate the liquid oxygen via the liquid oxygen absorber to remove the acetylene in the liquid oxygen, to ensure safe operation of the oxygenerator. In the plant, a long tube condensing evaporator is provided to increase the heat transfer efficiency. The liquid oxygen boils within the tubes and gas nitrogen condenses between tubes. Air is used as a medium in the expander. The middle extracted gas, after the carbon dioxide is removed in the carbon dioxide adsorber, is merged with the bypass gas from the lower column and enters the expander, and the expanded gas enters the upper column, which is Rehman gas.

FIG. 2 is a process schematic diagram of a reversible heat exchanger self-cleaning 10000 $m^3/h$ oxygenerator. In FIG. 2: 201—reversible heat exchanger, 202—automatic valve box, 203—liquefier (waste nitrogen), 204—liquefier (pure nitrogen), 205—liquefier (oxygen), 206—turbine expander, 207—lower column, 208—condensing evaporator, 209—upper column, 210—liquid air subcooler, 211—liquid oxygen subcooler, 212—liquid nitrogen subcooler, 213—liquid oxygen absorber, 214—liquid air absorber, 215—liquid oxygen pump. This refrigerating system is a full-low-pressure cycle based on Kapitza cycle. A high efficiency turbine expander is used, the expansion medium is air, and part of expansion work is recovered by motor braking. In the cleaning system, a plate-fin reversible heat exchanger automatically removes water and carbon dioxide. A liquid air absorber is provided to remove the acetylene in the enriched oxygen. Part of the liquid oxygen in the condensing evaporator is circulated by a liquid oxygen pump, and a liquid oxygen absorber is used to remove acetylene and other hydrocarbon compounds in the liquid oxygen. All heat exchangers in the plant are high efficiency plate-fin heat exchanger, therefore it is also called all-plate 10000 $m^3/h$ oxygenerator. The rectification column is of double-stage with an auxiliary column. The expanded gas enters the upper column, and this Rehman gas well links the refrigerating system of the oxygenerator with the rectification system.

FIG. 3 is a process schematic diagram of a 30000 $m^3/h$ external compression oxygenerator. In FIG. 3: AC—air cooling tower, AF—air filter, AP—liquid argon pump, TC—air centrifugal compressor, BT1—supercharger (expander), C1—lower column, C2—upper column, C701—crude argon column I, C702—crude argon column II, C703—pure argon column, E1—main heat exchanger, E2—liquid air liquid nitrogen subcooler, EH—electric heater, ET1—turbine expander, K1—main condensing evaporator, K701—crude argon condenser, K702—crude argon liquefier, K704—pure argon evaporator, MS1 and MS2—molecular sieve purifiers; PV701—liquid nitrogen balance, WC—water cooling tower, WP1 and WP2—water pump. This oxygenerator represents the 6th generation air separation process. Air is compressed by a centrifugal compressor and flows through the molecular sieve purifier to remove the moisture, carbon dioxide, acetylene and other hydrocarbon compounds in the air to be processed. Then the air flows into the plate-fin main heat exchanger to be cooled to the saturated temperature and enters the lower column. The Kapitza cycle is followed for liquefaction, and booster turbine expander is used for refrigeration, the expanded air enters the upper column. The upper column is a structured packing column, lower column is a sieve-plate column. The cold box is provided with crude argon column and pure argon column, both crude argon column and pure argon column are structured packing columns, realizing argon-free argon production. The gaseous oxygen leaves the column at a pressure of 21 kPa, and gaseous nitrogen at a pressure of 8 kPa, centrifugal oxygen compressor and nitrogen compressor are used to compress the products. It is a typical external compression process, so it is also called "metallurgical" type oxygenerator. In addition to the above-mentioned core technologies, double-bed molecular sieve purification technology, and high efficiency evaporating temperature reduction technology with double main cooling and nitrogen-water precooling system (without refrigerator) are used, achieving further energy conservation and consumption reduction in the air separation plants based on this process.

FIG. 4 is a process schematic diagram of a 52000 $m^3/h$ oxygenerator for chemical application. In FIG. 4: AC—air cooling tower, AF—air filter, ATC1—air centrifugal compressor, ATC2—air cycle supercharger, AP—liquid argon pump, C1—lower column, C2—upper column, C801—crude argon column I, C802—crude argon column II, C803—pure argon column, E1—main heat exchanger, E3—subcooler, ET—expander, BC—supercharger (expander), EC—water cooling tower, SH—steam heater, K1—main condensing evaporator, K801—crude argon condenser, K802—crude argon liquefier, K803—pure argon condenser, K804—pure argon evaporator, MS1 and MS2—molecular sieve purifier; NP—liquid nitrogen pump, OP—liquid oxygen pump. This oxygenerator is based on a typical internal compression process, with the features that: (1) the raw air compressor and air supercharger are both centrifugal compressors, driven by one turbine; (2) double-layer bed molecular sieve purifier is used, and impact-free switchover technology is adopted in the switchover system; (3) refrigeration is performed with a MP booster turbine expander, the refrigerating medium is air, after expansion the air enters the lower column; (4) the main heat exchangers are high efficiency plate-fin heat exchangers, consisting of two groups, respectively for high pressure and low pressure; (5) this air separation apparatus is provided with 6 product pumps, two liquid oxygen pumps, two liquid nitrogen pumps and two liquid argon pumps. They are all configured as one operating and one on cold online standby. It must be emphasized that the liquid oxygen pump, liquid nitrogen pump and liquid argon pump used for internal compression with this technology are worth high attention: the property of liquid oxygen, liquid nitrogen and liquid argon as almost incompressible fluid is utilized, as compared with the traditional technology of boosting with gas compressor (gas is a compressible fluid), obviously the power consumption of motors can be substantially reduced.

All the above four typical processes are based on the Rehman principle, the expanded air is blown into the upper column, or the gaseous nitrogen extracted from the lower column or the top of condensing evaporator is used, part of it is reheated by the circulating flow in the switchover heat exchanger before entering the turbine expander, the expanded nitrogen is diverted as product nitrogen, or be merged with waste nitrogen and reheated in the switchover heat exchanger to recover cold energy before venting. As nitrogen is introduced from the lower column, the condensing amount in the condensing evaporator has reduced, therefore less liquid component goes to the upper column, and the potential capacity of rectification can be used, this process based on nitrogen expansion has been adopted in large full-low-pressure air separation plants in foreign countries. Both air expansion and nitrogen expansion are aimed at reducing the liquid fraction in the upper column, to reduce the temperature difference between gas and liquid during rectification and make use of the potential of the upper column rectification, so as to make the full-low-pressure air separation plants more rational.

Gas separation in the above-mentioned traditional air separation apparatus is mainly based on thermodynamics, i.e. Carnot reverse cycle of identical temperature difference is used to analyze the refrigerating cycle process in air separation, the economic indicator of the refrigerating cycle is the refrigeration coefficient, or the ratio of obtained gain to the cost of consumption, and also, of all refrigerating cycles between atmospheric environment with temperature of $T_0$ and low temperature heat source with temperature of Tc (such as refrigeration store), the reverse Carnot cycle has the highest refrigeration coefficient:

$$\varepsilon_c = (COP)_{R,C} = \frac{q_2}{w_0} = \frac{T_c}{T_0 - T_c} \tag{1}$$

In the formula above, $\varepsilon_c$ is the refrigeration coefficient, $q_2$ refrigerating capacity of the cycle, and $w_0$ the net work consumed by the cycle.

The actual cycle efficiency is usually described by the ratio of refrigeration coefficient of actual cycle and theoretical cycling refrigeration coefficient, however, its theoretical basis is cyclic analysis of the air separation process with Carnot reverse cycle.

In fact, in his thesis "Reflections on the Motive Power of Heat", Carnot concluded that: of all heat engines working between two constant temperature heat sources of different temperatures, the reversible heat engine has the highest efficiency." This was later referred to as the Carnot theorem, after rearranging with the ideal gas state equation, the thermal efficiency of Carnot cycle obtained is:

$$\eta_c = 1 - \frac{T_2}{T_1} \tag{2}$$

In Formula (2), temperature $T_1$ of the high temperature heat source and temperature $T_2$ of low temperature heat source are both higher than the atmosphere ambient temperature $T_0$, and the following important conclusions can be obtained:

1) The thermal efficiency of Carnot cycle only depends on the temperature of high temperature heat source and low temperature heat source, or the temperature at which the media absorbs heat and release heat, therefore the thermal efficiency can be increased by increasing $T_1$ and $T_2$.

2) The thermal efficiency of Carnot cycle can only be less than 1, and can never be equal to 1, because it is not possible to realize $T_1=\infty$ or $T_2=0$. This means that a cyclic engine, even under an ideal condition, cannot convert all thermal energy into mechanical energy, of course, it is even less possible that the thermal efficiency is greater than 1.

3) When $T_1=T_2$, the thermal efficiency of the cycle is equal to 0, it indicates that in a system of balanced temperature, it is not possible to convert heat energy into mechanical energy, heat energy can produce power only with a certain temperature difference as a thermodynamic condition, therefore it has verified that it is not possible to build a machine to make continuous power with a single heat source, or the perpetual motion machine of the second kind does not exist.

4) Carnot cycle and its thermal efficiency formula are of important significance in the development of thermodynamics. First, it laid the theoretical foundation for the second law of thermodynamics; secondly, the research of Carnot cycle made clear the direction to raise the efficiency of various heat power engines, i.e. increasing the heat absorbing temperature of media and lowering the heat release temperature of media as much as possible, so that the heat is release at the lowest temperature that can be naturally obtained, or at the atmospheric temperature. The method mentioned in Carnot cycle to increase the gas heat absorbing temperature by adiabatic compression is still a general practice in heat engines with gas as media today.

5) The limit point of Carnot cycle is atmospheric ambient temperature, and for refrigerating process cycles below ambient temperature, Carnot cycle has provided no definite answer.

Because of the incompleteness of refrigeration coefficient, many scholars at home and abroad conducted research on it, and proposed methods to further improve it. In "Research on Energy Efficiency Standard of Refrigerating and Heat Pump Products and Analysis of Consummating Degree of Cyclic Thermodynamics", Ma Yitai et al, in conjunction with the analysis of introduction of the irreversible process of heat transfer with temperature difference into heat cycle by Curzon and Ahlborn and the enlightenment from the finite time thermodynamics created on it, as well as the CA cycle efficiency, proposed the consummating degree of thermodynamics of CA normal circulation, advancing to a certain extent the energy efficiency research on the refrigerating and heat pump products.

However, the basic theory of thermodynamics cannot make simple, clear and intuitional explanation of the circulation process of air separation apparatus. Einstein commented the classical thermodynamics this way: "A theory will give deeper impression to the people with simpler prerequisite, more involvement and wider scope of application." In the exploration of basic theory in the air separation refrigeration field, this point should be inherited and carried forward.

Therefore, it has become a difficult issue in the research of air separation technical field to research on the air separation refrigeration cycle, to really find the theoretical foundation for the air separation apparatus cycle and the correct direction to improve the air separation process, and to organize new air separation apparatus process on this theoretical foundation and substantially reduce the energy consumption of air separation apparatus.

Content of the Invention

The purpose of this invention is to improve the completeness of theoretical analysis in applying the Carnot theorem to air separation apparatus cycle, propose a new refrigerating theory corresponding to thermodynamic theory, or cold dynamics theory, and also propose a new air separation apparatus to produce oxygen and nitrogen by isobaric separation designed by applying this principle; any environment below the atmospheric ambient temperature is referred to as a cold source, corresponding to heat source above the ambient temperature; and corresponding to heat energy and heat, the corresponding concepts of cold energy and cold are proposed; the said refrigerating apparatus refers to that consuming mechanical power to realize transfer of cold energy from atmospheric environment to cryogenic cold source or from a cold source of low temperature to that of lower temperature. In the transfer of cold energy, some substance is required as working media in the refrigerating apparatus, and it is referred to as refrigerating media.

In the refrigerating process, the transfer of cold energy follows the energy conversion and conservation law.

To describe the cold transfer direction, conditions and limit in the refrigerating process, the second law of cold dynamics is proposed: the essence of the second law of cold dynamics is identical to that of the second law of thermodynamics, and it also follows the "energy quality declining principle", i.e. cold energy of different forms differs in "quality" in the ability to convert into power; and even the cold energy of the same form also has different ability of conversion at different status of existence. All actual processes of cold energy transfer are always in the direction of energy quality declination, and all cold energy spontaneously converts in the direction of atmospheric environment. The process to increase the quality of cold energy cannot perform automatically and independently, a process to increase energy quality is surely accompanied by another process of energy quality declination, and this energy quality declination process is the necessary compensating condition to realize the process to increase energy quality, that is, the process to increase energy quality is realized at the cost of energy quality declination as compensation. In the actual process, the energy quality declination process, as a cost, must be sufficient to compensate for the process to increase the energy quality, so as to meet the general law that the total energy quality must certainly decline. Therefore, with the given compensation condition for energy quality declination, the process to increase the energy quality surely has a highest theoretical limit. This theoretical limit can be reached only under the complete reversible ideal condition, in this case, the energy quality increase value is just equal to the compensation value for energy quality declination, so that the total energy quality remains unchanged. This shows that a reversible process is a pure and ideal process of energy quality conservation, in an irreversible process, the total energy quality must surely decline, and in no case it is possible to realize a process to increase the total energy quality in an isolated system. This is the physical connotation of the energy quality declining principle, the essence of the second law of cold dynamics, and also the essence of the second law of thermodynamics, and it reveals the objective law of the direction, conditions and limit of process that must be followed by all macroscopic processes.

The basic formula describing the second law of cold dynamics is:

$$\eta_c = 1 - \frac{T_{c2}}{T_{c1}} \tag{3}$$

In Formula (3), $Tc2<Tc1<T_0$, $T_0$ is the ambient temperature, all based on Kelvin temperature scale.

With respect to the ambient temperature $T_0$, the maximum cold efficiency of the cold source at Tc1 and Tc2 is:

$$\eta_c = 1 - \frac{T_{c1}}{T_0} \tag{4}$$

$$\eta_c = 1 - \frac{T_{c2}}{T_0} \tag{5}$$

Suppose $q_2$ is the refrigerating capacity of the cycle, and $w_0$ the net power consumed by the cycle, then when the cold source temperature is Tc1:

$$w_0 = \left(1 - \frac{T_{c1}}{T_0}\right)q_2 \quad (6)$$

Similarly, when the cold source temperature is Tc2:

$$w_0 = \left(1 - \frac{T_{c2}}{T_0}\right)q_2 \quad (7)$$

It is not difficult to see from Formulas (4) to (7) that, the efficiency of the cold dynamics is between 0 and 1, and due to unavoidable irreversibility in the actual process, the refrigerating cycle efficiency is always less than 1;

When the ambient temperature $T_0$ is determined, the lower cold source temperature, the more refrigerating capacity can be obtained with the same amount of power input from that cold source, and this has pointed out the direction for building new air separation apparatus processes.

It should be noted that:

(1) The cold is transferred spontaneously from the cryogenic cold source to ambient temperature;

(2) It is not possible to transfer cold from a cryogenic cold source to a cold source of lower temperature without causing other change;

(3) When the cold is transferred from a cryogenic cold source to the environment, the power exchanged with the outside is $w_0$, which includes the useless work $p_0(V_0-V_c)$ made to the environment, $p_0$ is the atmospheric pressure, $V_0$ the volume at ambient temperature, Vc the volume at cold source temperature, and the maximum reversible useful work made is:

$$(W_u)_{max} = W_0 - p_0(V_0 - V_c) = \left(1 - \frac{Tc}{To}\right)Q_0 - p_0(V_0 - V_c)$$

(4) When the cold is transferred from a cryogenic cold source to the environment, the useless energy transferred to the environment is:

$$E_{useless} = \frac{Tc}{To}Q_0$$

The useless work transferred to the environment is: $p_0(V_0-V_c)$

Corresponding to the useful energy "Yong" and useless energy "Jin" of heat quantity, and with the meanings of heat for fire and cold for water, the useful energy of cold energy is named as "cold energy lian", and the useless energy of cold energy transferred to the environment is named as "cold energy jin", and this "jin" is to water.

(5) When cold energy is transferred to environment, the best form of making work to the outside is using a temperature difference generator of Seebeck effect, or cold power generator;

(6) In cold dynamics, the energy must and also inevitably follow the energy conversion and conservation law;

(7) With reference to the conception of finite time thermodynamics, it is possible to develop the basic theory of finite time cold dynamics;

(8) The quality of cold energy cannot be assessed by separating it from the specific environment;

(9) Cold dynamics and thermodynamics are two branches of the energetics, and are a unity of opposites: in a cryogenic refrigerating cycle, while following the second law of cold dynamics, the cycle process of refrigerant media formed in the cryogenic environment also follows the Rankine cycle, so it comes back to the Carnot law, just in line with the principle of the Chinese traditional aesthetics that yin and yang mutually complement.

It can be seen from the theoretical foundation above that, the supposed cold dynamics has a theoretical framework system symmetric to thermodynamics, so it complies with the basic principle of scientific aesthetics, or the principle of opposite and complementary symmetricity.

On the basis of the afore-said cold dynamics basic principle, this invention has proposed a process organization different from the traditional air separation apparatus, to realize a new way to produce oxygen and nitrogen by isobaric separation of air, and also effectively reduce the energy consumption of air separation apparatus.

The purpose of this invention is realized with the following measures:

An air separation apparatus to produce oxygen and nitrogen through isobaric separation, in which the following process steps are adopted to realize isobaric separation of air:

(1) Raw air 1 flows through air filter 2 to remove dust and mechanical foreign substance, and enters the air compressor 3 to be compressed to the desired pressure;

(2) The precooled compressed air enters purifier 4 to remove moisture, carbon dioxide and small amount of acetylene and hydrocarbon compounds, and then cooled via main cold exchanger 6 to the liquefaction temperature, before entering lower column 8 of the rectification apparatus;

(3) In lower column 8 rough distillation is performed to obtain oxygen-enriched liquid air 11, after removing acetylene in liquid air absorber 12 and supercooling in subcooler 42, it is directly sent to the middle of the upper column without throttling, and after liquid nitrogen washing, it flows via condensing evaporator 9 to evaporate to produce nitrogen, and obtain liquid oxygen and oxygen;

(4) The liquid nitrogen produced in condensing evaporator 9 flows back to lower column 8 as reflux liquid; part of liquid nitrogen product can also be diverted out directly, and the remaining liquid nitrogen is used as reflux liquid to the lower column; the gaseous nitrogen 13 diverted out from the middle or top of lower column flows via subcooler 42 to condense into liquid nitrogen 22, and is sent to the top of upper column 10, to participate in the rectification process of the upper column;

(5) The liquid oxygen 14 obtained from rectification in upper column 10 flows via liquid oxygen pump 15 and liquid oxygen absorber 16 to remove acetylene and hydrocarbon compounds, and returns to the bottom of upper column, to form the liquid oxygen circulation circuit; or the liquid oxygen 14 after removing acetylene via liquid oxygen pump 15 and liquid oxygen absorber 16 is sent out directly as product 17; or it is boosted by liquid oxygen booster pump 33, and after recovering cold energy by main cold exchanger 6, is sent out as product HP oxygen 34;

(6) The waste nitrogen is diverted out from the bottom of the auxiliary column of the upper column, and flows via waste nitrogen pipeline 37 and main cold exchanger 6 to recover cold energy, then it is sent to the nitrogen and water precooler or is vented directly;

(7) The oxygen 35 without expansion and pressure reduction, after being diverted from upper column 10, flows via main cold exchanger 6 or via auxiliary cold exchanger 41 and main cold exchanger 6 to recover cold energy, and is then output as product oxygen 36;

(8) In main cold exchanger 6, cold is supplied by the gaseous nitrogen 23 diverted from the top of upper column and gaseous oxygen 35 diverted from the bottom of upper column and waste nitrogen as the cold sources, to cool the pre-cleaned air 5, and then it enters the lower column and the rectification apparatus to separate out nitrogen and oxygen;

(9) Auxiliary cold exchanger 41 provides cold with a cold makeup system, or provides cold with the gaseous nitrogen 23 diverted from the top of upper column and gaseous oxygen 35 diverted from the bottom of upper column and waste nitrogen as the cold sources, to cool the air 40 to the liquefaction temperature;

(10) The circulation process of the refrigerating media in the cold makeup system is:

The cold makeup system of the said apparatus refers to the process that liquid refrigerant 19 from refrigerant tank 18, flows via hydraulic pump 20, cold regenerator 21, or/and nitrogen liquefier 29, subcooler 42, or/and auxiliary cold exchanger 41, to form the refrigerating media superheated vapor 24, after expansion and temperature reduction via expander 25, it flows via cold regenerator 21 again and throttle valve 27 and returns to the refrigerant tank 18, to make up the required cold energy via the subcooler 42 or/and auxiliary cold exchanger 41 to the air separation system, so as to form the cold dynamic cycle circuit of the refrigerant; the pressure of the cold makeup system can be conveniently regulated via throttle valve 27.

The braking equipment 28 of the said expander 25 refers to fan, motor, hydraulic pump or gas compressor.

(11) It is provided with nitrogen liquefier 29: the liquid refrigerant 19 from refrigerant tank 18, after boosting via hydraulic pump 20, flows via cold regenerator 21, nitrogen liquefier 29, subcooler 42 and cold regenerator 21, and returns to the refrigerant tank 18; nitrogen 23 is condensed via nitrogen liquefier 29 into product liquid nitrogen 22, or after recovering cold energy via liquid nitrogen booster pump 31 and main cold exchanger 6, is output as HP nitrogen 32.

The said isobaric separation refers to the process that the raw air coming into the air separation rectification system requires no expansion for pressure reduction and refrigeration as in the traditional air separation process, and the air coming out of compressor is only subjected to resistance loss in the equipment and pipes along the way, so it can be taken as an isobaric separation process.

The said rectification system consists of the lower column, condensing evaporator and upper column, in an integrated or separated structure.

The said purifier 4 consists of the molecular sieve purifier, reversible cold exchanger or stone cooler, to ensure continuous and normal operation of the process.

The said refrigerating media has a boiling point lower than or equal to that of oxygen under standard atmospheric pressure, including, but not limited to one or more rare gases as liquid nitrogen, liquid argon, liquid neon and liquid helium if safety can be guaranteed, liquid oxygen or liquid hydrogen can also be used, with liquid nitrogen as a preference.

The said refrigerant tank 18 is provided with necessary thermal and cold insulation, such as thermal isolated vacuum container, and insulation materials such as pearlite.

The said main cold exchanger 6, auxiliary cold exchanger 41, cold regenerator 21 and subcooler 42 are tube-shell type, plate-fin, micro channel or other types of cold exchanger, their structure and cold exchange elements are identical to the tube-shell type heat exchanger, plate-fin heat exchanger, micro channel heat exchanger in the traditional air separation process, the more precise names are used in their place only for the purpose of corresponding to the refrigerating system.

There can be one or a number of the said subcooler 42 and auxiliary cold exchanger 41, to respectively supercool nitrogen 13, oxygen-enriched liquid air 11 and liquid oxygen via the cold makeup system.

There can be one or a number of the said main cold exchanger 6, for precooling treatment of air 5.

The equipment and their backup systems, pipes, instruments, valves, cold insulation and bypass facilities with regulation functions not described in this invention shall be configured with mature technologies of generally known traditional refrigerating cycles.

Safety and regulation and control facilities associated with the refrigerating cycle apparatus of this invention are provided, so that the apparatus can operate economically and safely with high thermal efficiency, to achieve the goal of energy conservation, consumption reduction and environmental protection.

This invention has the following advantages as compared with existing technologies:

1. Substantial energy conservation effect: the air expander or nitrogen expander in the traditional air separation cycle is cancelled, by using the property of liquid as an almost incompressible fluid, the cryogenic liquid circulating pump is used to increase pressure and make up cold, to realize isobaric separation of air, it can effectively increase the efficiency of refrigerating cycle, and compared with a traditional air separation apparatus, with the same refrigerating capacity, energy can be saved by over 30%.

2. The product gas pressure is increased by liquid nitrogen pump and liquid oxygen pump, to save large amount of power consumption.

3. By increasing the operation pressure of the rectifying column, it can smoothly realize saving the compression work for product oxygen and nitrogen output, equipment such as oxygen compressor and nitrogen compressor, and the associated cooling water system.

4. Simpler process flow setup can bring into full play the potential of the rectification system, and the operation can be more flexible and more convenient in regulation.

5. The equipment and materials inventory can be substantially reduced.

6. By using the liquid oxygen pump and liquid nitrogen pump in the air separation system for isobaric separation of nitrogen and oxygen, it can increase the pressure of gaseous oxygen and nitrogen efficiently with energy conservation, and realize centralized gas supply, similar to the traditional centralized steam heat supply technology, with far-reaching social and economic significance.

DESCRIPTION OF FIGURES

In FIG. 1: 101—cold accumulator, 102—automatic valve box, 103—turbine expander, 104—expansion filter, 105—liquefier, 106—lower column, 107—condensing evaporator, 108—upper column, 109—liquid oxygen absorber, 110—liquid air adsorber, 111—liquid air subcooler, 113—liquid oxygen pump, 114—carbon dioxide absorber.

In FIG. 2: 201—reversible heat exchanger, 202—automatic valve box, 203—liquefier (waste nitrogen), 204—liquefier (pure nitrogen), 205—liquefier (oxygen), 206—turbine expander, 207—lower column, 208—condensing evaporator, 209—upper column, 210—liquid air subcooler, 211—liquid oxygen subcooler, 212—liquid nitrogen subcooler, 213—liquid oxygen absorber, 214—liquid air absorber, 215—liquid oxygen pump.

In FIG. 3: AC—air cooling tower, AF—air filter, AP—liquid argon pump, TC—air centrifugal compressor, BT1—supercharger (expander), C1—lower column, C2—upper column, C701—crude argon column I, C702—crude argon column II, C703—pure argon column, E1—main heat exchanger, E2—liquid air liquid nitrogen subcooler, EH—electric heater, ET1—turbine expander, K1—main condensing evaporator, K701—crude argon condenser, K702—crude argon liquefier, K704—pure argon evaporator, MS1 and MS2—molecular sieve purifiers; PV701—liquid nitrogen balance, WC—water cooling tower, WP1 and WP2—water pump.

In FIG. 4: AC—air cooling tower, AF—air filter, ATC1—air centrifugal compressor, ATC2—air cycle supercharger, AP—liquid argon pump, C1—lower column, C2—upper column, C801—crude argon column I, C802—crude argon column II, C803—pure argon column, E1—main heat exchanger, E3—subcooler, ET—expander, BC—supercharger (expander), EC—water cooling tower, SH—steam heater, K1—main condensing evaporator, K801—crude argon condenser, K802—crude argon liquefier, K803—pure argon condenser, K804—pure argon evaporator, MS1 and MS2—molecular sieve purifier; NP—liquid nitrogen pump, OP—liquid oxygen pump.

In FIG. 5: 1—air, 2—air filter, 3—gas compressor, 4—cleaner, 5—pre-cleaned air, 6—main cold exchanger, 7—air coming into lower column, 8—lower column, 9—condensing evaporator, 10—upper column, 11—oxygen-enriched liquid air, 12—liquid air absorber, 13—lower column' nitrogen, 14—liquid oxygen, 15—liquid oxygen pump, 16—liquid oxygen absorber, 17—liquid oxygen, 18—refrigerant tank, 19—liquid refrigerant, 20—hydraulic pump, 21—cold regenerator, 22—liquid nitrogen, 23—cryogenic nitrogen, 24—refrigerating media superheated vapor, 25—expander, 26—expander outlet exhaust, 27—throttle valve, 28—braking equipment, 29—nitrogen liquefier, 30—liquid nitrogen, 31—liquid nitrogen booster pump, 32—HP nitrogen, 33—liquid oxygen booster pump, 34—HP oxygen, 35—cryogenic oxygen, 36—product oxygen, 37—waste nitrogen pipeline, 38—waste nitrogen, 39—product nitrogen, 40—air, 41—auxiliary cold exchanger, 42—subcooler.

EMBODIMENTS

In the following, this invention is further described in detail in conjunction with figures and embodiments.

Embodiment 1

Figure 1:
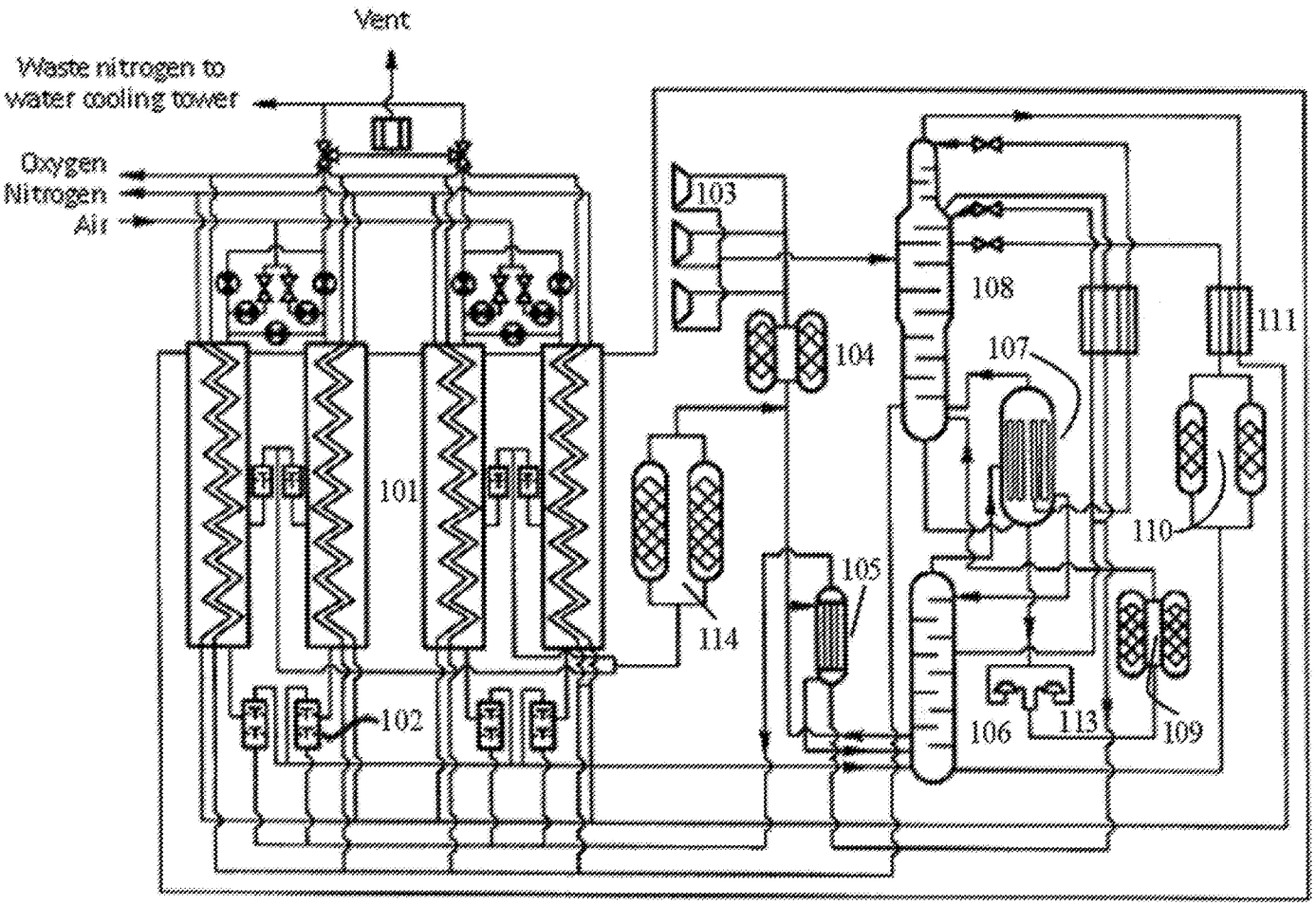
Prior Art Figure 1
FIG. 1 is a process schematic diagram of a 3200 $m^3$/h tube type oxygenerator.
Figure 2:
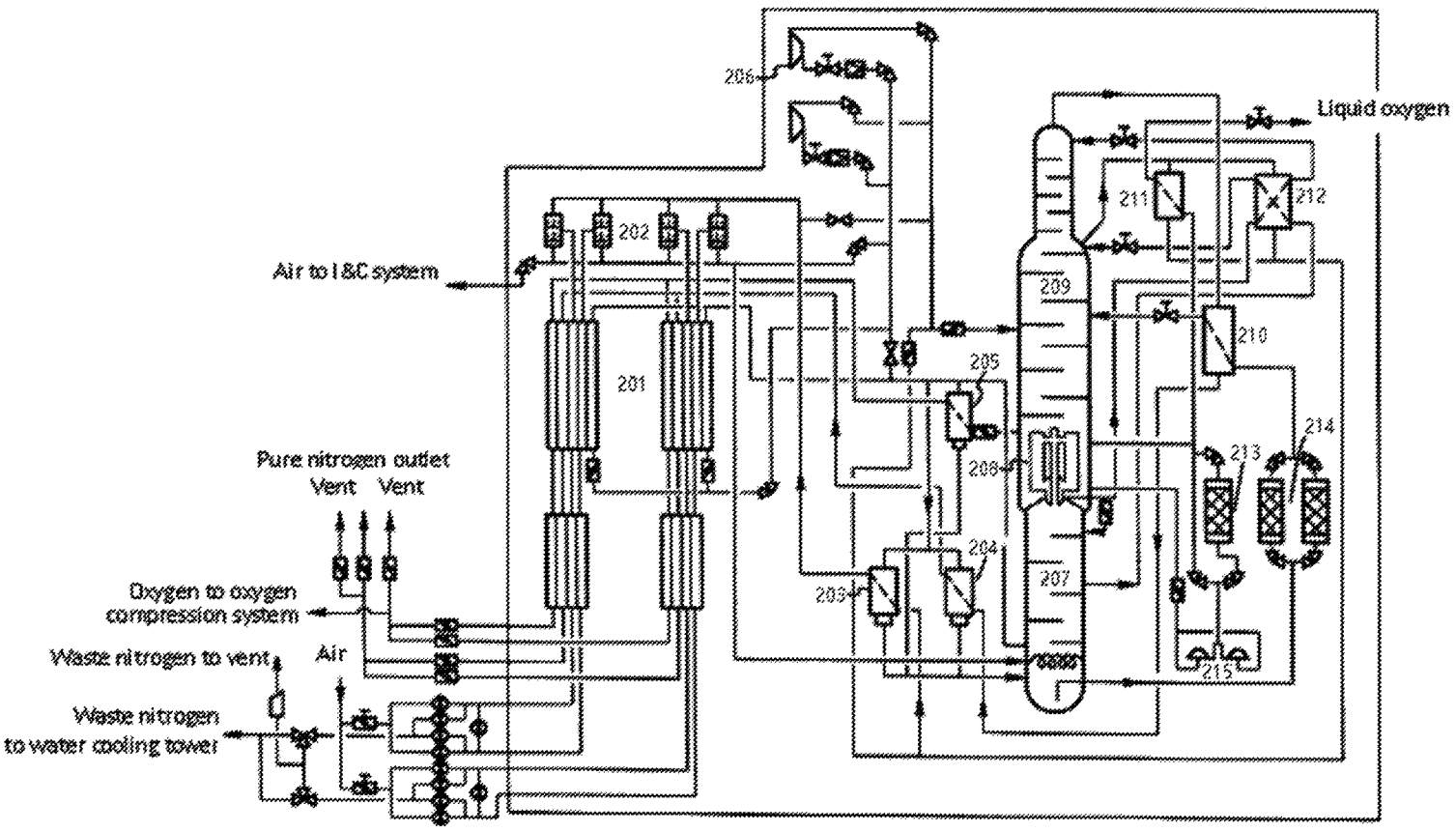
Prior Art Figure 2
FIG. 2 is a process schematic diagram of a reversible heat exchanger self-cleaning 10000 $m^3$/h oxygenerator.
Figure 3:
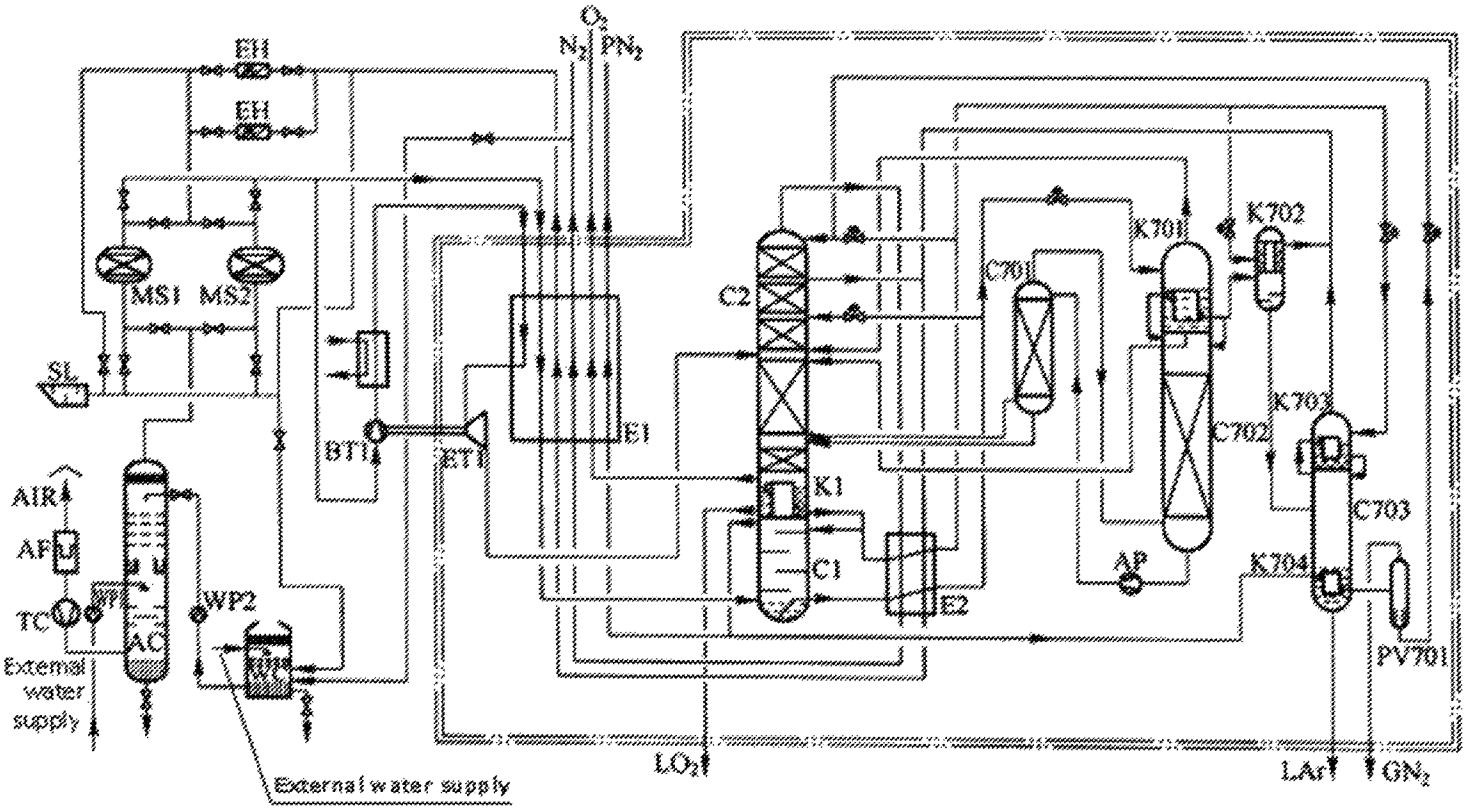
Prior Art Figure 3
FIG. 3 is a process schematic diagram of a 30000 $m^3/h$ external compression oxygenerator.
Figure 4:
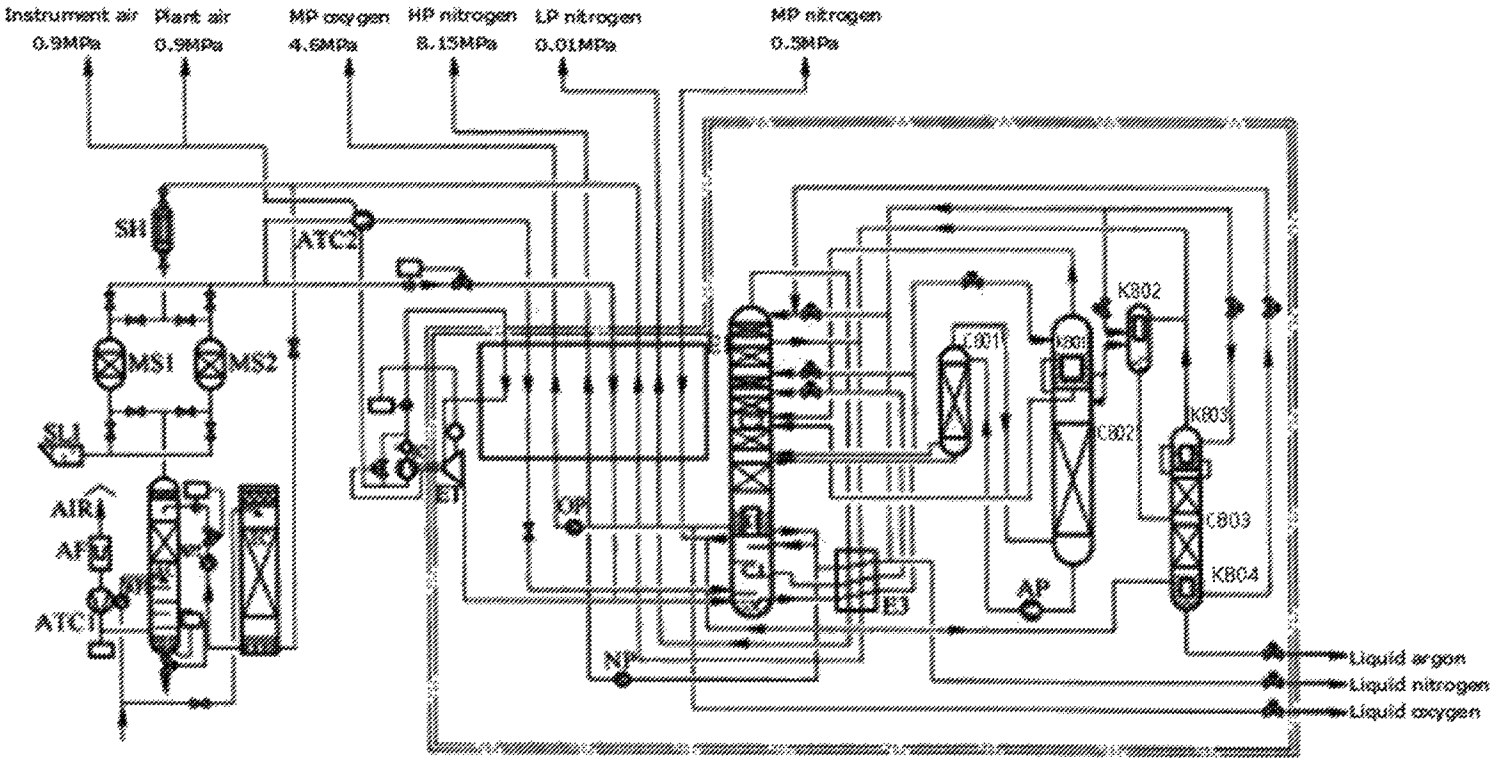
Prior Art Figure 4
FIG. 4 is a process schematic diagram of a 52000 $m^3/h$ oxygenerator for chemical application.
Figure 5:
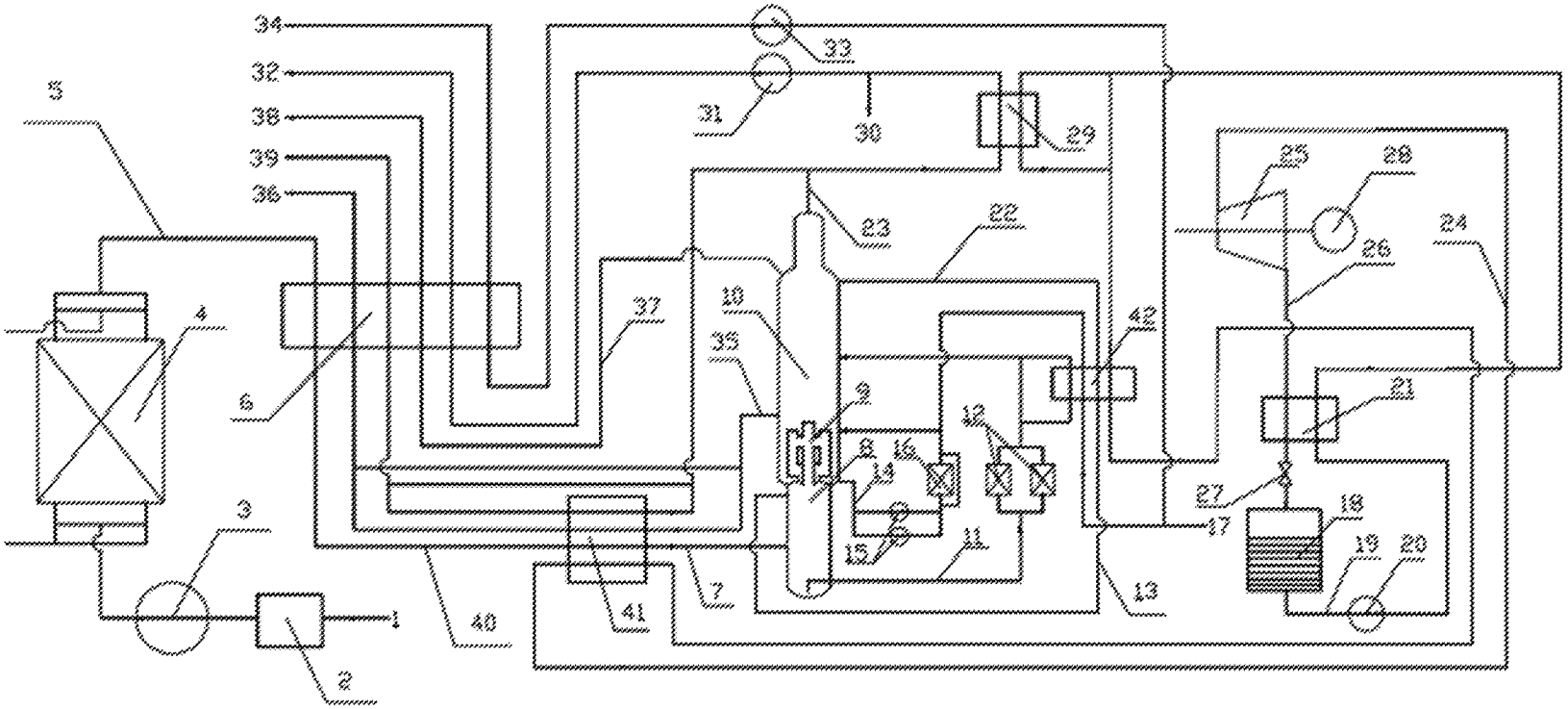
FIG. 5 is a process schematic diagram of an air separation apparatus to produce oxygen and nitrogen through isobaric separation of this invention.

As shown in FIG. 5, an air separation apparatus to produce oxygen and nitrogen through isobaric separation, with liquid nitrogen gas as refrigerating media, with the specific embodiment as follows:

(1) Raw air 1 flows through air filter 2 to remove dust and mechanical foreign substance, and enters the air compressor 3 to be compressed to the desired pressure;

(2) The precooled compressed air enters purifier 4 to remove moisture, carbon dioxide and small amount of acetylene and hydrocarbon compounds, and then cooled via main cold exchanger 6 to the liquefaction temperature, before entering lower column 8 of the rectification apparatus;

(3) In lower column 8 rough distillation is performed to obtain oxygen-enriched liquid air 11, after removing acetylene in liquid air absorber 12 and supercooling in subcooler 42, it is directly sent to the middle of the upper column without throttling, and it flows via condensing evaporator 9 to evaporate to produce nitrogen, and obtain liquid oxygen and oxygen;

(4) The liquid nitrogen produced in condensing evaporator 9 flows back to lower column 8 as reflux liquid;

(5) The liquid oxygen 14 obtained from rectification in upper column 10 flows via liquid oxygen pump 15 and liquid oxygen absorber 16 to remove acetylene and hydrocarbon compounds, and returns to the bottom of upper column, to form the liquid oxygen circulation circuit; or the liquid oxygen 14 after removing acetylene via liquid oxygen pump 15 and liquid oxygen absorber 16 is sent out directly as product 17; or it is boosted by liquid oxygen booster pump 33, and after recovering cold energy by main cold exchanger 6, is sent out as product HP oxygen 34;

(6) The waste nitrogen is diverted out from the bottom of the auxiliary column of the upper column, and flows via waste nitrogen pipeline 37 and main cold exchanger 6 to recover cold energy, then it is sent to the nitrogen and water precooler or is vented directly;

(7) In main cold exchanger 6, cold is supplied by the gaseous nitrogen 23 diverted from the top of upper column and gaseous oxygen 35 diverted from the bottom of upper column and waste nitrogen as the cold sources, to cool the pre-cleaned air 5, and then it enters the lower column and the rectification apparatus to separate out nitrogen and oxygen;

(7) Auxiliary cold exchanger 41 provides cold with a cold makeup system, or provides cold with the gaseous nitrogen 23 diverted from the top of upper column and gaseous oxygen 35 diverted from the bottom of upper column and waste nitrogen as the cold sources, to cool the air 40 to the liquefaction temperature;

(8) The circulation process of the refrigerating media in the cold makeup system is:

The cold makeup system of the said apparatus refers to the process that liquid refrigerant 19 from refrigerant tank 18, flows via hydraulic pump 20, cold regenerator 21, nitrogen liquefier 29, subcooler 42, and auxiliary cold exchanger 41, to form the refrigerating media superheated vapor 24, after expansion and temperature reduction via expander 25, it flows via cold regenerator 21 again and throttle valve 27 and returns to the refrigerant tank 18, to make up the required cold energy via the subcooler 42 and auxiliary cold exchanger 41 to the air separation system, so as to form the cold dynamic cycle circuit of the refrigerant; the braking equipment 28 of the said expander 25 refers to an air compressor, design to increase pressure of the gas product oxygen or nitrogen.

Nitrogen 23 is condensed via nitrogen liquefier 29 into product liquid nitrogen 22, or after increasing pressure via liquid nitrogen booster pump 31 and recovering cold energy via main cold exchanger 6, is output as HP nitrogen 32.

The said refrigerant tank 18 is provided with necessary thermal and cold insulation, such as thermal isolated vacuum container, and insulation materials such as pearlite.

The equipment and their backup systems, pipes, instruments, valves, cold insulation and bypass facilities with regulation functions not described in this invention shall be configured with mature technologies of generally known traditional refrigerating cycles.

Safety and regulation and control facilities associated with the air separation cycle apparatus of this invention are provided, so that the apparatus can operate economically and safely with high thermal efficiency, to achieve the goal of energy conservation, consumption reduction and environmental protection.

This invention has been made public with an optimum embodiment as above, however, it is not used to restrict this invention, all variations or decorations made by those familiar with this technology without deviating from the spirit and scope of this invention also falls into the scope of protection of this invention. Therefore, the scope of protection of this invention shall be that defined by the claims in this application.

The invention claimed is:

1. An air separation apparatus to produce oxygen and nitrogen through isobaric separation, comprising:

an air purifying system for air purification, which comprises an air compressor for moving an air stream through an air purifier to obtain a pre-cleaned air stream;

a precooling system for cooling the pre-cleaned air stream from the air purifying system, the precooling system comprises a main cold exchanger and an auxiliary cold exchanger for cooling the pre-cleaned air stream;

a rectification system for separating nitrogen and oxygen from the pre-cooled air from the precooling system, the rectification system comprises a nitrogen liquefier, a subcooler, and a rectification apparatus having an upper column, a lower column, and a condensing evaporator disposed between the upper column and the lower column, and the condensing evaporator is fluidly connected with the lower column, wherein the lower column receives the pre-cooled air from the auxiliary cold exchanger and separates the pre-cooled air into an oxygen-rich liquid air stream and a first gaseous nitrogen stream, the upper column receives a first liquid nitrogen stream from the subcooler, the subcooler receives the first gaseous nitrogen stream from the lower column and cools the first gaseous nitrogen stream to form the first liquid nitrogen stream, and the nitrogen liquefier condenses a second gaseous nitrogen stream from the upper column to obtain a second liquid nitrogen stream; and a cold makeup system for supplying cold energy to the rectification system, the cold makeup system comprises:

a refrigerant tank containing a liquid refrigerant, a hydraulic pump for transferring the liquid refrigerant through the nitrogen liquefier and the subcooler in the rectification system, and the auxiliary cold exchanger in the pre-cooling system to obtain a superheated refrigerant stream, an expander for expanding the superheated refrigerant, and a cold regenerator that cools the superheated refrigerant from the expander.

2. The apparatus as described in claim 1, wherein, in the cold makeup system, the refrigerant from the hydraulic pump cools the expanded superheated refrigerant from the expander in the cold regenerator.

3. The apparatus as described in claim 2, wherein the rectification system further comprises a liquid air absorber fluidly connected with the lower column and the subcooler, wherein the oxygen-rich air from the lower column passes the liquid air absorber before entering the subcooler.

4. The apparatus as described in claim 1, wherein the expander comprises a braking equipment that is a fan, a motor, a hydraulic pump, or a gas compressor.

5. The apparatus as described in claim 4, wherein the expander expands and cools the superheated refrigerant.

6. The apparatus as described in claim 5, wherein the rectification system further comprises a liquid oxygen booster pump and a liquid oxygen absorber, wherein the liquid oxygen booster pump pumps a liquid oxygen stream from the upper column through the liquid oxygen absorber and the main cold exchanger to produce a pressurized product oxygen stream.

7. The apparatus as described in claim 6, wherein the lower column, the condensing evaporator, and the upper column are integrated in one housing.

8. The apparatus as described in claim 7, wherein the air purifier is a molecular sieve purifier, a reversible cold exchanger, or a stone cooler.

9. The apparatus as described in claim 6, wherein the lower column, the condensing evaporator, and the upper column are in separated structures.

* * * * *